United States Patent [19]

Stone

[11] 4,103,454

[45] Aug. 1, 1978

[54] FOLDING ASSEMBLED ARTICLE SUCH AS A TOY AIRPLANE

[76] Inventor: Myron Stone, 188 Polifly Rd., Hackensack, N.J. 07601

[21] Appl. No.: 798,472

[22] Filed: May 19, 1977

[51] Int. Cl.[2] ..... A63H 27/00

[52] U.S. Cl. ..... 46/79

[58] Field of Search ..... 46/76 R, 79, 81

[56] References Cited

U.S. PATENT DOCUMENTS

| | | | |
|---|---|---|---|
| 1,420,194 | 6/1922 | Howard | 46/76 R |
| 2,005,842 | 6/1935 | Marcus | 46/76 R |
| 2,396,886 | 3/1946 | Rossiter | 46/76 R |

*Primary Examiner*—Louis G. Mancene
*Assistant Examiner*—Robert F. Cutting
*Attorney, Agent, or Firm*—Samuelson & Jacob

[57] ABSTRACT

A folding assembled article in the form of a toy airplane has a fuselage of paper folded along a longitudinal line and a paper wing assembled with the fuselage and movable between a folded configuration, wherein the assembly is flat for packaging purposes, and an erect configuration, wherein the wing is maintained in an extended lateral position relative to the fuselage for flight.

11 Claims, 6 Drawing Figures

FOLDING ASSEMBLED ARTICLE SUCH AS A TOY AIRPLANE

The present invention relates generally to articles constructed of assembled members of sheet material, such as paper, and pertains, more specifically, to a folding assembly, such as a toy airplane, capable of folding flat for packaging and ready erection for use.

A wide variety of articles have been constructed of members of sheet materials in either knock-down form or in folding assemblies for effective packaging and ease of erection for use. Various structures constructed of sheeted paper, cardboard, wood, metal and synthetic resin materials often are supplied in a knock-down or folded form which provides a compact package for storage and distribution and enables ease of erection for use. One such article which is very popular and traditionally has been sold in knock-down or folded form is a toy airplane constructed of paper or a like lightweight sheet material. Those toy airplanes which are sold in knock-down form require assembly in order to prepare them for use. Others, which are folded or otherwise packaged in assembled form, usually require supplemental reinforcing structural elements to place and maintain them in an erected configuration.

It is an object of the present invention to provide an assembled article constructed of sheet material, such as a toy airplane, capable of folding for ease of packaging and distribution, and ready erection for use.

Another object of the invention is to provide an assembled article, such as a paper airplane, in which the fuselage and wing are assembled prior to packaging, are folded in assembled form for packaging, and are erected readily for use without requiring supplemental assembly or reinforcing elements.

Still another object of the invention is to provide a toy paper airplane in which the fuselage and the wing are fabricated as separate components, are then assembled and folded for packaging and distribution and are readily erected for use by merely opening the assembly from the folded configuration to an erect configuration.

A further object of the invention is to provide a toy paper airplane having a selectively variable flight configuration for enabling selective adjustment of performance characteristics, such as adjustments for indoor or outdoor flight.

A still further object of the invention is to provide a toy paper airplane which is economically fabricated in large numbers of controlled high quality and which exhibits exceptional performance with minimal effort by way of erection and adjustment for use.

The above objects, as well as still further objects and advantages, are attained by the present invention which may be described briefly as a folding assembly, such as a toy airplane, capable of being folded to a flat configuration and selectively erected to an operating configuration, the assembly comprising a longitudinally extending first member of sheet material folded along a longitudinal line into a pair of juxtaposed side-by-side parts, a pair of curved slots in the first member, the curved slots being located one in each of the parts so as to be juxtaposed with one another in the folded first member, and a second member of sheet material passing through the juxtaposed slots and having a fold line located between the side-by-side parts and being aligned longitudinally parallel to the longitudinal line in the first member, the fold line dividing the second member into sections, the sections being movable between a first position, wherein the sections are relatively flat and folded into juxtaposition with one another along the fold line in the second member, and a second position wherein the sections extend in generally opposite directions from the fold line therein, and portions of the sections adjacent the slots, including a portion containing the fold line, are curved to conform generally to the curve of the slots so as to maintain the sections in the second position against inadvertent return toward the first position.

The invention will be more fully understood, while further objects and advantages will become apparent, in the following detailed description of a preferred embodiment of the invention illustrated in the accompanying drawing, in which.

Figure 1:
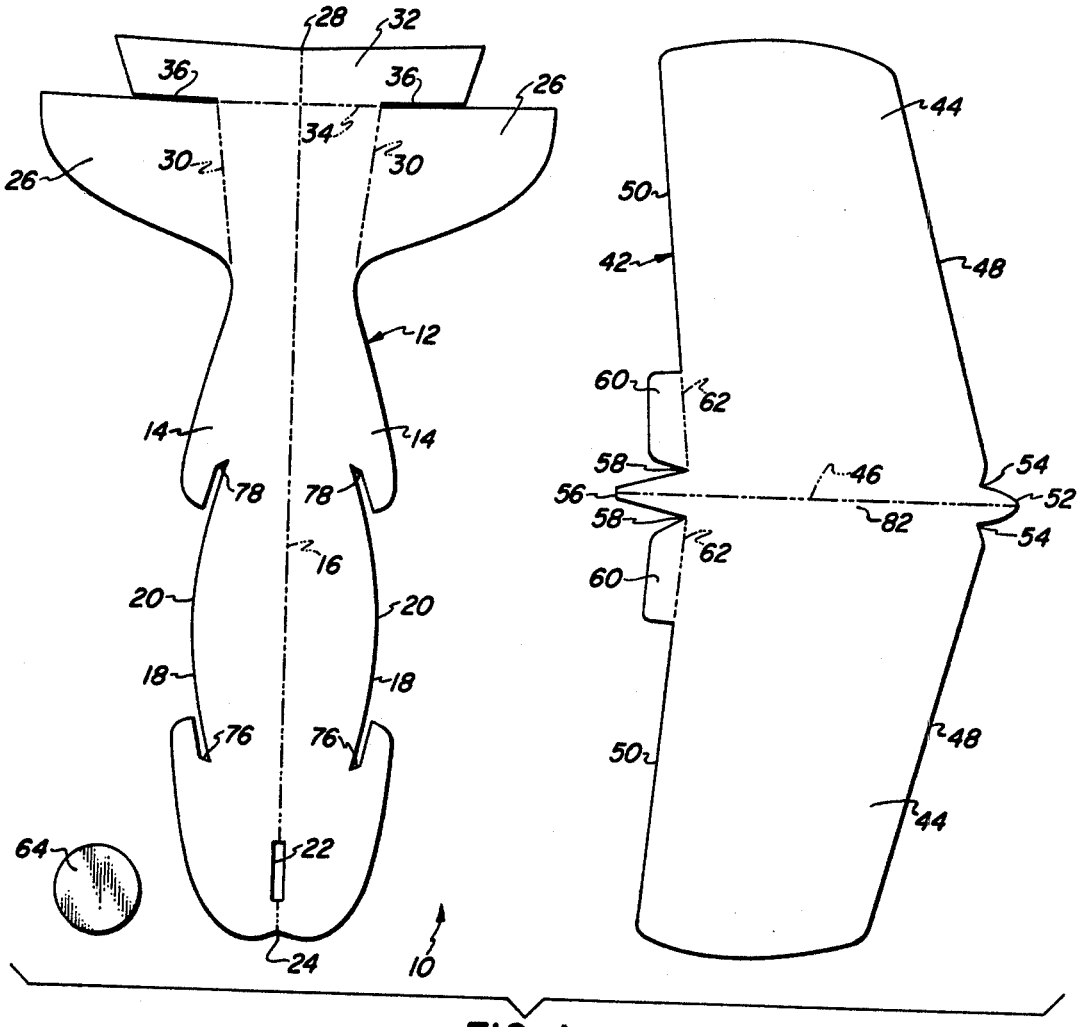
FIG. 1 is a plan view of the component parts of a toy paper airplane constructed in accordance with the invention, prior to assembly of the airplane.

Referring now to the drawing, and especially to FIG. 1 thereof, a toy paper airplane which will be constructed in accordance with the invention is illustrated generally at 10 in the form of individual component parts to be assembled.

A first member 12 is divided into symmetric parts 14 by a longitudinal fold line 16. Each part 14 includes a curved slot 18 which, in this instance, is open at the top 20 of the curve of the slot 18. An aperture 22 is placed along the fold line 16 adjacent the front end 24 of first member 12, and lateral extensions 26 project from parts 14 adjacent the back end 28 of first member 12, a fold line 30 being placed between each extension 26 and the corresponding part 14. A rearmost portion 32 is located between a lateral score line 34 and the back end 28 and is separated from lateral extensions 26 by slits 36.

A second member 42 is divided into symmetric sections 44 by a fold line 46. Each section 44 has a leading edge 48 and a trailing edge 50. A forward projection 52 extends forward of leading edges 48 and is bounded by forward notches 54, each spaced laterally from fold line 46. A rearward projection 56 extends rearward of trailing edges 50 and is bounded by rearward notches 58, each spaced laterally from fold line 46. Adjacent each rearward notch 58 is a flap 60 extending rearwardly from each trailing edge 50 and contiguous therewith along a score line 62.

First and second members 12 and 42 are die cut from paper sheet stock, with slots 18, aperture 22, slits 36 and notches 54 and 58 all being formed in the die cutting operation in the conventional manner.

A third member is provided in the form of a disk 64, preferably of metal, which will serve as a weight to balance the assembled airplane for flight.

Figure 2:
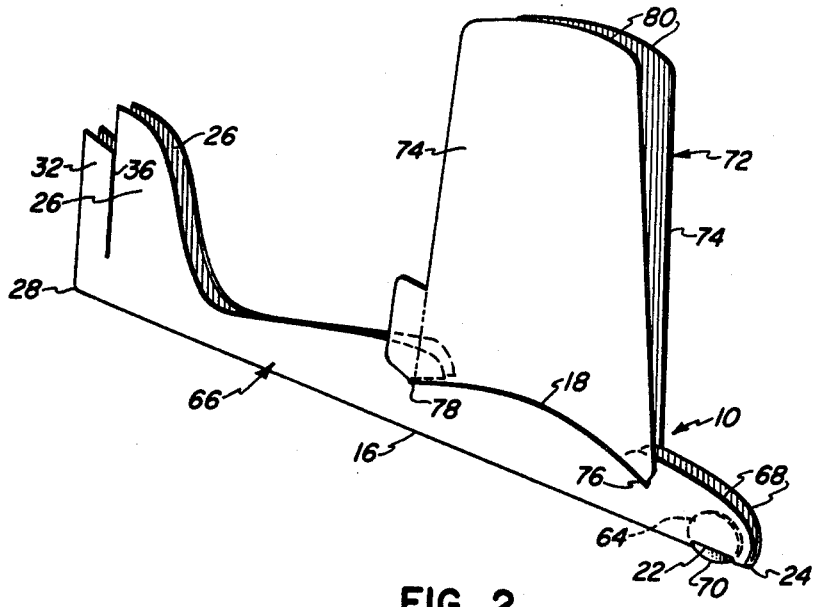
FIG. 2 is a perspective view of the airplane assembled and in folded configuration.
Figure 3:
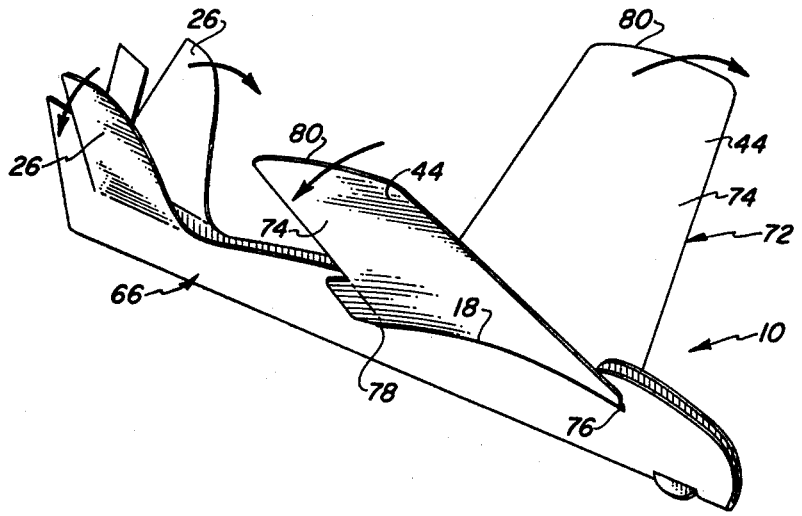
FIG. 3 is a perspective view of the assembled airplane in an intermediate configuration.
Figure 4:
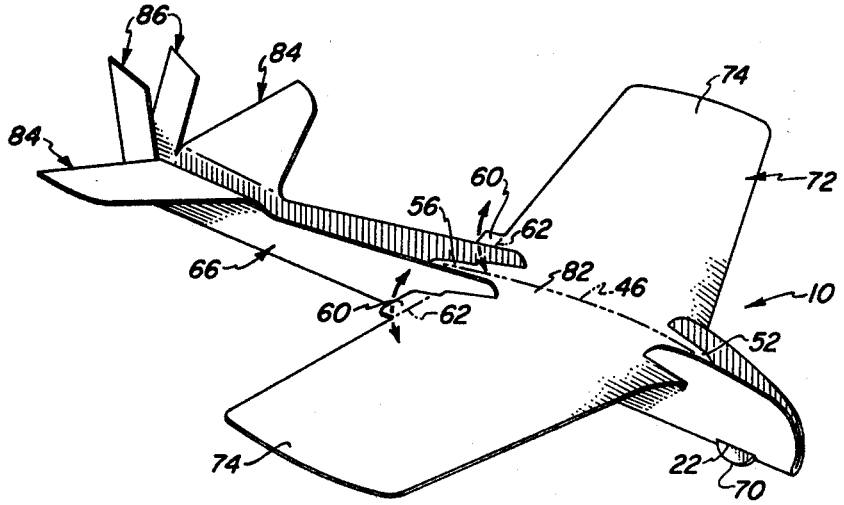
FIG. 4 is a perspective view of the assembled airplane in an erect configuration.

Turning now to FIGS. 2, 3 and 4, airplane 10 is assembled by folding first member 12 along fold line 16 so that parts 14 are juxtaposed with one another in side-by-side relationship to establish a fuselage 66. Disk 64 is placed in aperture 22 and, preferably, a small amount of adhesive (not shown) is applied between the disk 64 and the corresponding nose portions 68 of the parts 14 to secure the disk 64 in place within the nose portion of fuselage 66 and to maintain the parts 14 in the folded configuration. It is noted that placement of the disk 64 within aperture 22 serves to locate the disk 64 accurately relative to fuselage 66, by virtue of the accuracy with which aperture 22 can be die cut, so that appropriate balance is assured. Accurate location of disk 64 also provides the appropriate balanced forward thrust upon launching airplane 10 for proper flying characteristics. Furthermore, the relative dimensions of aperture 22 and disk 64 enable the disk 64 to protrude downwardly from fuselage 66, thereby providing a landing skid 70 at the most advantageous location in fuselage 66.

Upon folding first member 12 along fold line 16, slots 18 are juxtaposed with one another. Second member 42 is then located within the slots 18 so as to extend laterally from the fuselage 66 and establish a wing 72, each section 44 representing a wing half 74. Each forward notch 54 engages a forward end 76 of a corresponding slot 18, while each rearward notch 58 engages a rearward end 78 of a corresponding slot 18 to lock wing 72 in place within fuselage 66. The slots 18 are bowed so that the ends 76 and 78 of each slot are closer to fold line 16 than the top 20 of that slot. The wing halves 74 are folded about central fold line 46, which is now aligned longitudinally parallel to fold line 16, and lies below the slots 18, between the slots and the fold line 16, so that the wing halves are brought into a first position wherein the wing halves 74 are flat and in juxtaposition with one another, as seen in FIG. 2. In such folded configuration, airplane 10 is completely assembled but is in a flat state suitable for packaging in a simple envelope or a like package for storage, distribution and sale.

In order to erect airplane 10 for use, the wing 72 is unfolded, preferably by grasping the wing tips 80 and moving the wing halves 74 about fold line 46, as seen in FIG. 3, until the wing halves 74 are brought to a second position wherein the wing halves 74 extend in generally opposite directions from fold line 46, which is raised to become aligned generally with slots 18, as seen in FIG. 4. Since the length of each slot 18, along the curve between the forward and rearward ends 76 and 78 of each slot 18, is about equal to the length of the wing halves 74 between the forward and rearward notches 54 and 58, at least that portion of the wing 72 at the slots 18 will conform to the curvature of the slots 18, causing the central portion 82 of the wing 72, and the fold line 46 therein, to bow upwardly. At the same time, the parts 14 of fuselage 66 in the vicinity of slots 18 are spread apart somewhat by virtue of the location of forward notches 54 at either side of forward projection 52 and the location of rearward notches 58 at either side of rearward projection 56. The upward bowing of the wing 72 at the fold line 46 will lock the wing in the conformed configuration, thereby maintaining the wing halves 74 in the second position against inadvertent return toward the first, or folded, position. In other words, the bow in the portion 82 of the wing 72 which includes the fold line 46 precludes inadvertent folding of the wing halves 74 about the fold line 46. No supplemental reinforcing elements are required. Thus, the wing 72 is erected and maintained in a laterally extending condition for flight. The lateral extensions 26 are then folded down along fold lines 30 to establish horizontal stabilizers 84 at the tail portion of fuselage 66, as seen in FIG. 4. The rearmost portion 32 remains in the upward projecting position to serve as a vertical stabilizer 86, thereby completing the empennage of the aircraft. The airplane 10 is then ready for flight.

It will be apparent that the aircraft 10 is readily erected for flight, once it is removed from its package, by merely grasping the wing tips 80 and pulling gently to open the wing 72 to the fully erect laterally extending position. The horizontal stabilizers 84 are then folded down and the aircraft is ready for use. The entire erection procedure can be reversed for storage of the airplane. Thus, by pressing downwardly upon the central portion 82 of the wing 72, and upon score line 46, the wing again can be flattened and folded about the fold line 46 to return to the position illustrated in FIG. 2.

When erected for flight, the flight configuration of airplane 10 may be modified selectively to alter the flight characteristics of the airplane. Thus, flaps 60 may be raised or lowered by bending each flap about the respective score line 62. In executing a banking turn for a circular return flight, the flaps may be lowered to shorten the radius of the circular flight or raised to lengthen the radius. Since the flaps 60 are located immediately adjacent the root of each wing half 74, the aerodynamic effect of the flaps 60 is one of changing the lift characteristics of the wing for stunt flying purposes. The flaps need extend along only a relatively short portion of the length of each wing half 74 to attain the desired effect.

Figure 5:
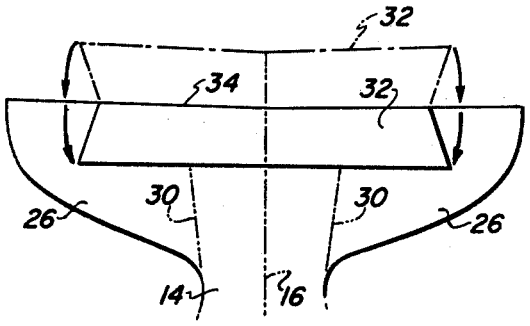
FIG. 5 is a fragmentary plan view of the tail portion of the airplane illustrating a construction scheme for erecting an empennage with an alternate flight configuration.
Figure 6:
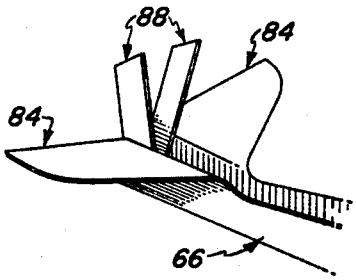
FIG. 6 is a fragmentary perspective view of the empennage of the airplane showing the erected alternate flight configuration.

Turning now to FIGS. 5 and 6, the flight characteristics of airplane 10 can be modified to compensate for indoor and outdoor flying. Thus, it has been found that the longer fuselage configuration, as illustrated in FIGS. 2 through 4 is appropriate for indoor flights; however, a shorter fuselage configuration is advantageous for outdoor flights. In order to obtain the shorter fuselage configuration, rearmost portion 32 of first member 12 is folded upwardly and forwardly about score line 34 to a forward position, as seen in FIG. 5. Upon folding first member 12 about fold line 16, as shown in FIG. 6, rearmost portion 32 will project upwardly to establish a vertical stabilizer 88 placed forward of the position of vertical stabilizer 86 shown in FIG. 4. Thus, a shorter fuselage configuration is attained, which shorter fuselage has been found to improve the outdoor flying capabilities of airplane 10.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A folding assembly, such as a toy airplane, capable of being folded to a flat configuration and selectively erected to an operating configuration, the assembly comprising:

a longitudinally extending first member of sheet material folded along a longitudinal line into a pair of juxtaposed side-by-side parts;

a pair of curved slots in the first member, the curved slots being located one in each of said parts so as to be juxtaposed with one another in the folded first member; and a second member of sheet material passing through the juxtaposed slots and having a fold line located between the side-by-side parts and being aligned longitudinally parallel to the longitudinal line in the first member, the fold line dividing the second member into sections, the sections being movable between a first position, wherein the sections are relatively flat and folded into juxtaposition with one another along the fold line in the second member, and a second position wherein the sections extend in generally opposite directions from the fold line therein, and portions of the sections adjacent the slots, including a portion containing the fold line, are curved to conform generally to the curve of the slots so as to maintain the sections in the second position against inadvertent return toward the first position.

2. The invention of claim 1 wherein:

the slots are bowed so that the ends of the slots are closer to the longitudinal line in the first member than portions of the slots between the ends thereof; and the fold line in the second member is located between the slots and the longitudinal line in the second member when the sections are in the first position, and is located generally in alignment with the slots when the sections are in the second position.

3. The invention of claim 2 wherein:

the first member is a fuselage extending longitudinally between a nose portion and a tail portion;

the second member is a wing extending laterally between opposite wing tips and the sections are wing halves; and a weight is located adjacent the nose portion for balancing the erected assembly for flight.

4. The invention of claim 3 wherein:

the fuselage includes an aperture located on the longitudinal line adjacent the nose portion; and the weight is located between the side-by-side parts and extends downwardly through the aperture to establish a landing skid adjacent the nose portion of the fuselage.

5. The invention of claim 3 wherein:

the wing halves each have a leading edge and a trailing edge;

a forward notch is located in each leading edge and is spaced laterally from the fold line in the wing;

a rearward notch is located in each trailing edge and is spaced laterally from the fold line in the wing; and each forward and rearward notch is engaged with a corresponding end of a corresponding slot in the fuselage to lock the wing in place in the fuselage.

6. The invention of claim 5 wherein the wing includes:

a forwardly extending projection located between the forward notches and placed between the side-by-side parts of the fuselage; and a rearwardly extending projection located between the rearward notches and placed between the side-by-side parts of the fuselage.

7. The invention of claim 3 wherein the first and second members are constructed of paper.

8. The invention of claim 3 wherein:

the wing halves each have a leading edge and a trailing edge; and a flap is located on each wing half at the trailing edge thereof, each flap being located closely adjacent the corresponding part of the fuselage and being selectively movable to positions located upwardly and downwardly relative to the wing.

9. The invention of claim 3 wherein the fuselage includes a pair of lateral extensions adjacent the tail portion thereof, the lateral extensions being located one on each of the side-by-side parts of the fuselage and being movable into laterally opposite positions, corresponding to the second position of the wing halves, to establish horizontal stabilizers.

10. The invention of claim 9 wherein the fuselage includes a rearmost laterally extending portion at the tail portion of the fuselage and a lateral fold line between the rearmost portion and the lateral extensions, the rearmost portion being foldable about the lateral fold line between a first position rearward of the lateral fold line and a second position forward of the lateral fold line to establish a vertical stabilizer at a selected one of the first and second positions.

11. In a toy paper airplane having a fuselage extending between a nose portion and a tail portion and including juxtaposed parts folded side-by-side about a longitudinal fold line, an empennage comprising:

a pair of lateral extensions adjacent the tail portion of the fuselage, the lateral extensions being located one on each of the side-by-side parts of the fuselage and being movable into laterally opposite positions, corresponding to the second position of the wing halves, to establish horizontal stabilizers;

a rearmost laterally extending portion at the tail portion of the fuselage; and a lateral fold line between the rearmost portion and the lateral extensions, the rearmost portion being foldable about the lateral fold line between a first position rearward of the lateral fold line and a second position forward of the lateral fold line to establish a vertical stabilizer at a selected one of the first and second positions.

* * * * *